US008756959B2

(12) United States Patent
Johnson

(10) Patent No.: US 8,756,959 B2
(45) Date of Patent: Jun. 24, 2014

(54) CHEMICAL INJECTION DISPENSER AND CAP

(75) Inventor: Daryl T. Johnson, Ripon, WI (US)

(73) Assignee: Alliance Laundry Systems, LLC, Ripon, WI (US)

( * ) Notice: Subject to any disclaimer, the term of this patent is extended or adjusted under 35 U.S.C. 154(b) by 838 days.

(21) Appl. No.: 12/568,258

(22) Filed: Sep. 28, 2009

(65) Prior Publication Data

US 2011/0072860 A1 Mar. 31, 2011

(51) Int. Cl.
*D06F 35/00* (2006.01)

(52) U.S. Cl.
USPC ..... 68/207; 222/129

(58) Field of Classification Search
CPC ..... D06F 39/022; D06F 39/088; D06F 39/08
USPC ..... 68/17 R, 207; 210/323.2; 222/129, 416
See application file for complete search history.

(56) References Cited

U.S. PATENT DOCUMENTS

| | | | | |
|---|---|---|---|---|
| 2,101,348 | A | 12/1937 | Schellinger | |
| 3,298,207 | A * | 1/1967 | Bannon, Jr. | 68/17 R |
| 3,328,054 | A | 6/1967 | Fecho | |
| 3,381,700 | A * | 5/1968 | Frymark | 137/216 |
| 4,208,179 | A | 6/1980 | Gelsing et al. | |
| 4,369,806 | A * | 1/1983 | Noren | 137/216 |
| 5,207,764 | A | 5/1993 | Akabane et al. | |
| 5,323,808 | A | 6/1994 | Shimizu | |
| 5,425,255 | A * | 6/1995 | Pick | 68/207 |
| 5,782,112 | A * | 7/1998 | White et al. | 68/207 |
| 5,944,210 | A * | 8/1999 | Yetter | 220/4.21 |
| 7,658,088 | B2 * | 2/2010 | Walker et al. | 68/17 R |
| 2005/0173323 | A1 * | 8/2005 | Meuleners et al. | 210/184 |
| 2005/0235703 | A1 * | 10/2005 | Cho et al. | 68/17 R |
| 2006/0107705 | A1 | 5/2006 | Hsu et al. | |
| 2008/0107576 | A1 * | 5/2008 | Zettlitzer et al. | 422/266 |
| 2008/0295546 | A1 * | 12/2008 | Cho et al. | 68/17 R |
| 2009/0293556 | A1 * | 12/2009 | Lee et al. | 68/17 R |
| 2010/0139010 | A1 * | 6/2010 | Lee et al. | 8/159 |

FOREIGN PATENT DOCUMENTS

WO WO 2008/122851 A1 10/2008

* cited by examiner

*Primary Examiner* — Michael Kornakov
*Assistant Examiner* — Marc Lorenzi
(74) *Attorney, Agent, or Firm* — Leydig, Voit & Mayer, Ltd.

(57) ABSTRACT

A washing machine having a chemical dispenser for dispensing chemicals into the wash water during a washing operation. The dispenser includes a dispenser body having a water inlet and a cap having a plurality of hose connecting ports to which chemical supply hoses are individually attached for enabling the direction of chemical into the dispenser chamber simultaneous with the introduction of water from the water inlet. The chemical supply hoses are connectable to the cap at a location remote from said body, and the cap is removable and replaceable in said dispenser body without removal of the hose from the connecting ports.

15 Claims, 4 Drawing Sheets

CHEMICAL INJECTION DISPENSER AND CAP

FIELD OF THE INVENTION

The present invention relates generally to washer extractors, and more particularly, to an improved chemical dispenser for supplying chemicals such as detergents, softeners, sours, bleaches, and the like, into the wash water of a washer extractor during a washing cycle.

BACKGROUND OF THE INVENTION

In large commercial washers used in on-premise commercial laundries, chemicals, such as detergent and various wash water additives, are held in reservoirs, such as plastic barrels, remote from the washer and are supplied to the washer via peristaltic pumps that direct the chemical through respective hoses to the washing machine for dispensing into the wash water. Current chemical dispenser systems to which the chemical supply hoses connect have been relatively costly and problem prone.

Such dispenser systems commonly have a plastic body mounted in a back side of the washing machine with molded ports to which the chemical supply hoses are connected, which selectively supply the chemicals into the dispenser for direction into wash water. Such dispensers are made of relatively inexpensive plastic material that can be susceptible to the corrosive effects of chemicals commonly used in clothes washing operations and breakage or leakage from over stressing or loose clamping of the hose connectors, resulting in the undiluted chemicals running down the side of the machine onto other components of the machine or into the discharge hose of the dispenser, which can lead to deterioration of the discharge hose. If strain reliefs or ports are assembled as individual parts into the dispenser, this requires more components and assembly time, resulting in higher costs. Moreover, when it is necessary to remove the back panel of the washing machine for service or repair, each of the chemical supply hoses must be individually disconnected from the ports of the dispenser. Reconnection of the multiplicity of hoses further increases a risk of port damage and leakage from improper hose clamping.

OBJECTS AND SUMMARY OF THE INVENTION

It is an object of the present invention to provide a washer extractor having a chemical dispenser that minimizes the risk of damage to hose connecting ports and harmful leakage of chemicals supplied to the wash machine.

Another object is to provide a washer extractor having a chemical dispenser as characterized above which permits service and repair of the washing machine, including disassembly of the machine cabinet, without disconnecting the chemical supply hoses from their respective connecting ports.

A further object is to provide a washer extractor having a chemical dispenser of the foregoing type which is adapted to prevent or minimize harmful leakage of undiluted chemicals from the hose connecting ports onto other components of the machine or into the dispenser discharge hose.

Still another object is to provide a washer extractor having a chemical dispenser of the above kind in which connecting ports for the chemical supply hoses are less susceptible to breakage or corrosion from the dispensed chemicals.

Yet a further object is to provide a chemical dispenser for washer extractors of the above kind which is relatively simple in construction, facilitates convenient connection and removal of supply hoses to the connector ports, and which is economical in design.

Other objects and advantages of the invention will become apparent upon reading the following detailed description and upon reference to the drawings, in which:

Figure 1:
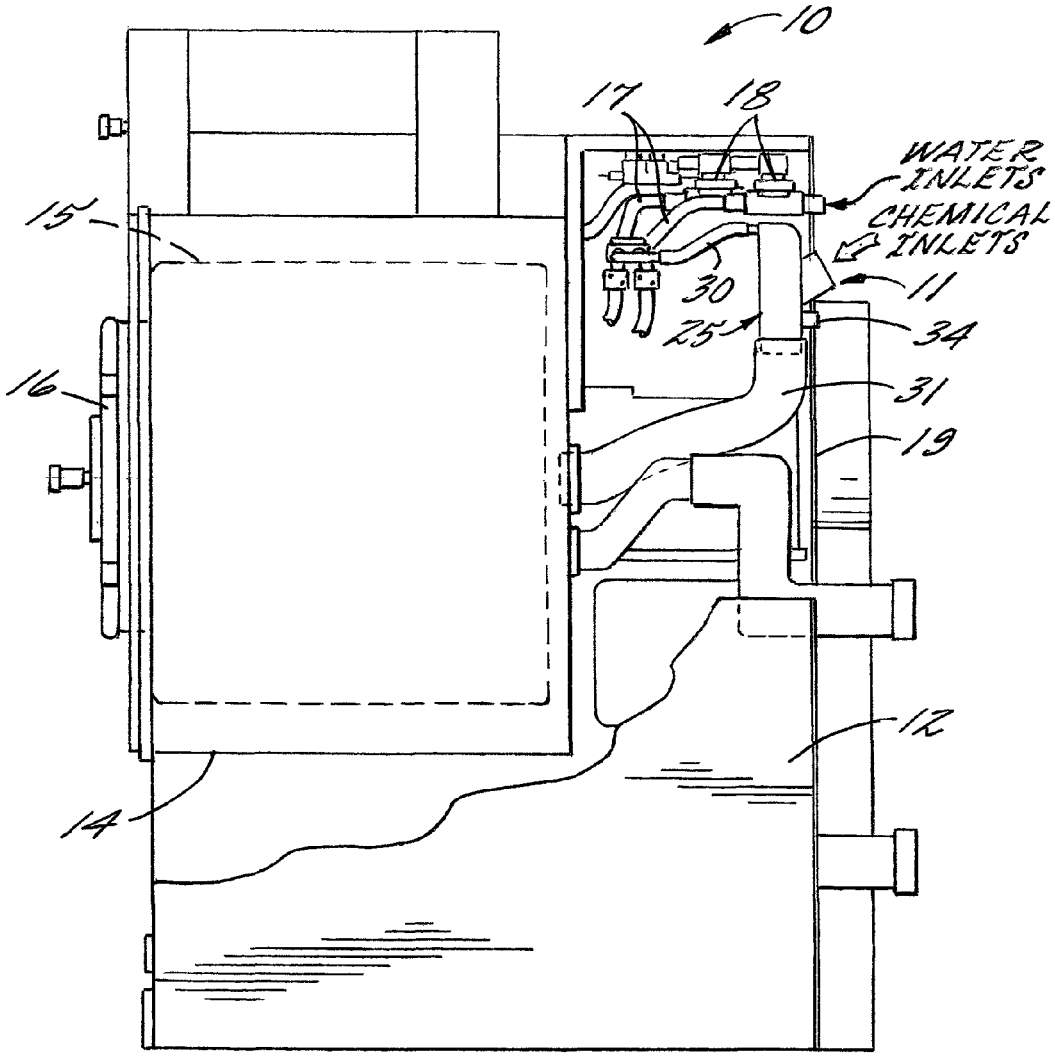
FIG. 1 is a side elevational view of an illustrative washer/extractor having a chemical dispenser in accordance with the invention.
Figure 1A:
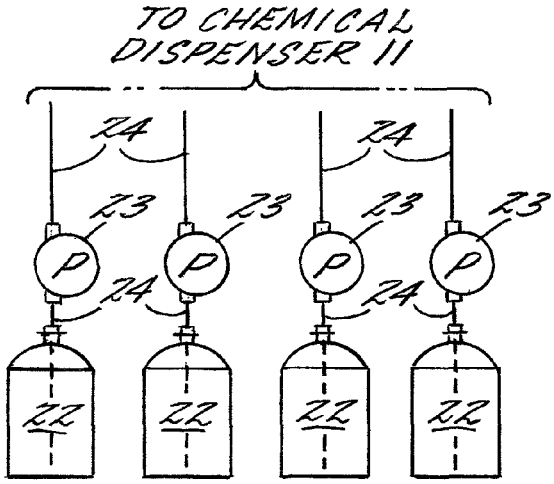
FIG. 1A is a diagrammatic depiction of chemical containers or barrels from which chemicals are supplied to the chemical dispenser of the illustrated washer/extractor.
Figure 2:
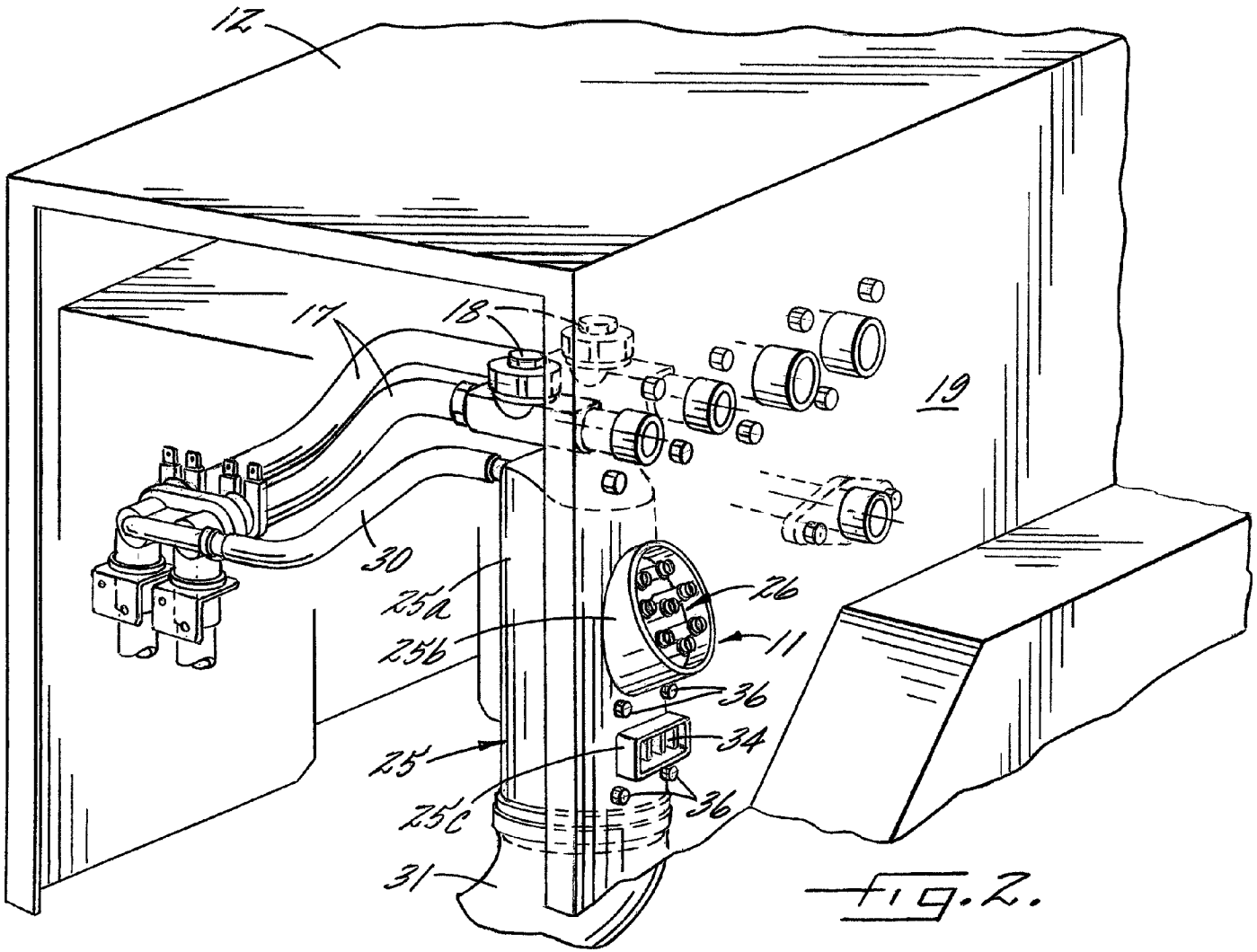
FIG. 2 is a rear perspective of the illustrated washer/extractor, with portions broken away.
Figure 3:
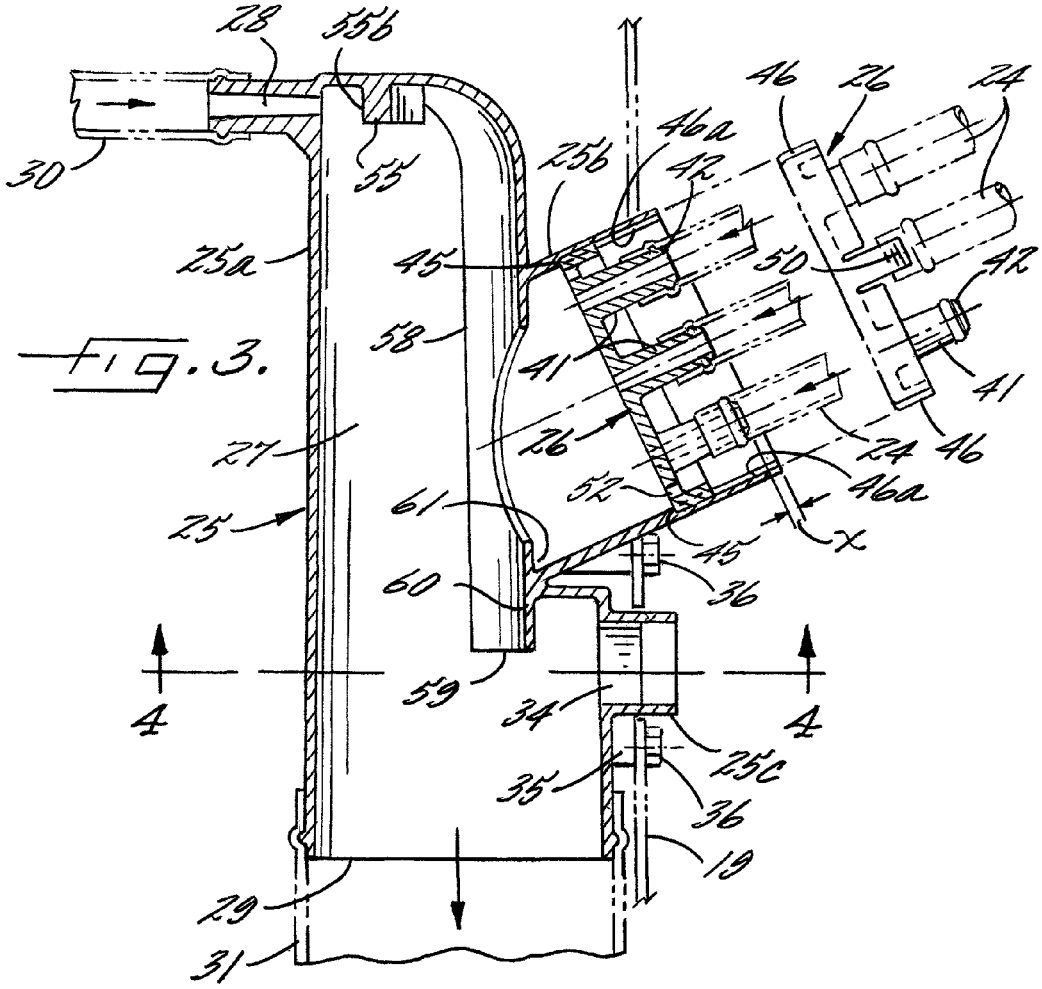
FIG. 3 is an enlarged fragmentary section of the chemical dispenser of the illustrated machine, with the hose connecting cap thereof shown in phantom in a removed condition.
Figure 4:
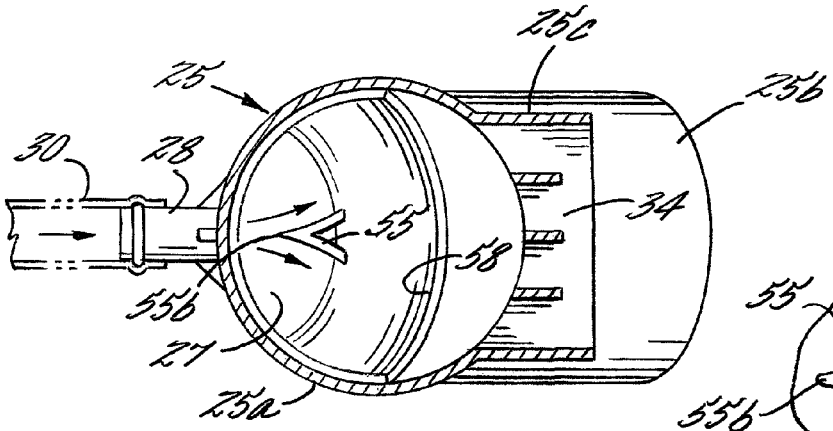
FIG. 4 is a transverse section, taken in the plane of line 4-4 in FIG. 3
Figure 4A:
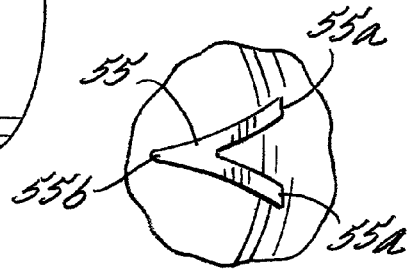
FIG. 4A is an enlarged view of a liquid diverter located downstream of the illustrated chemical dispenser.
Figure 5:
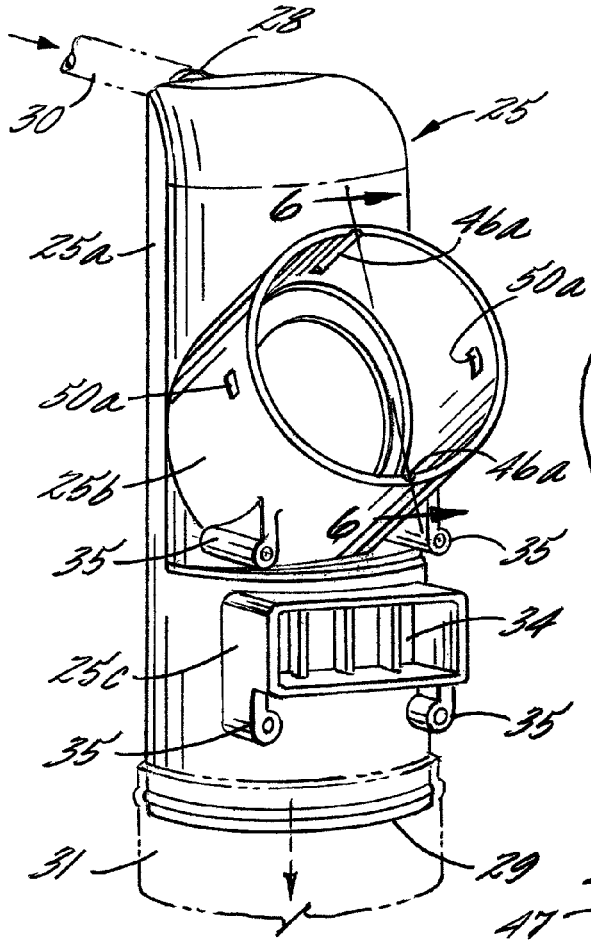
FIG. 5 is a perspective of the body of the illustrated chemical dispenser.
Figure 6:
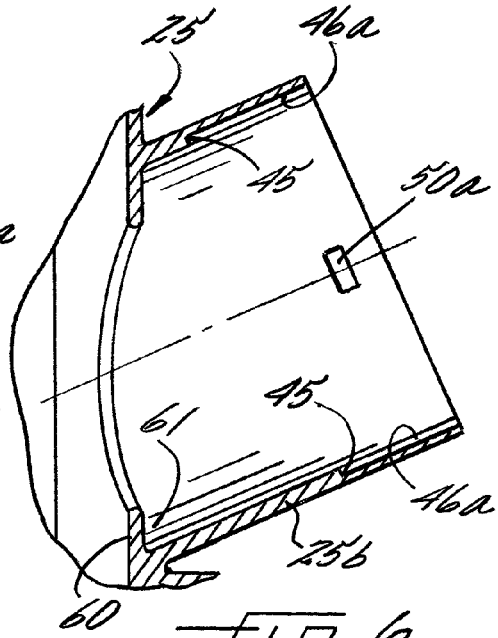
FIG. 6 is an enlarged fragmentary section taken in the plane of line 6-6 in FIG. 5.
Figure 7:
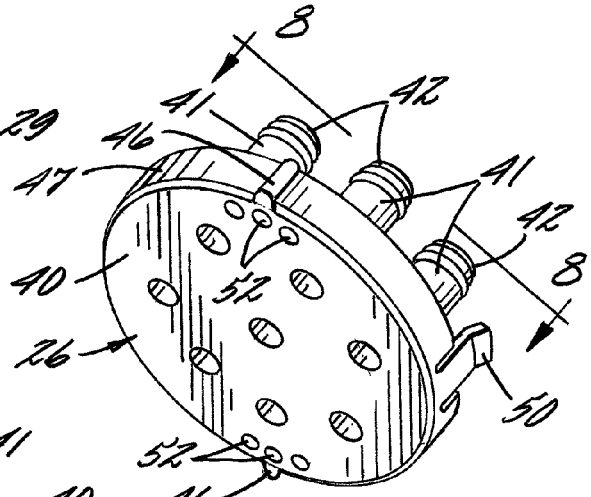
FIG. 7 is a perspective of the hose connecting cap of the illustrated dispenser.
Figure 8:
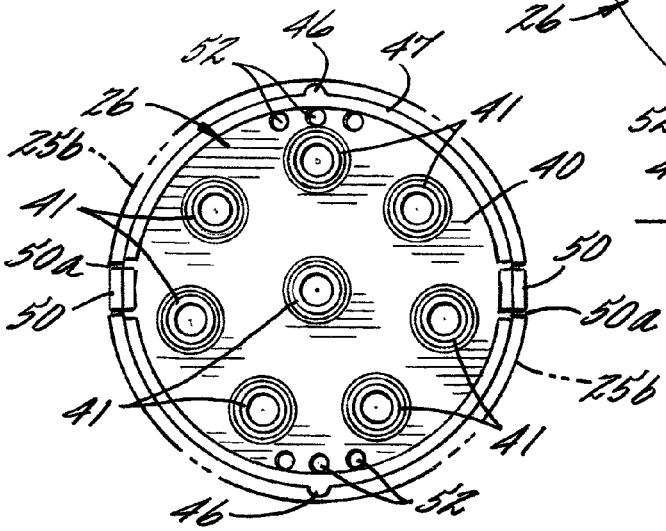
FIG. 8 is a side view of the hose connecting cap taken in the plane of line 8-8 in FIG. 7.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

Description Of The Preferred Embodiments

Referring now more particularly to the drawings, there is shown an illustrated washer/extractor 10 having a chemical dispenser 11 in accordance with the invention. The illustrated washer/extractor 10 is a washing machine of a type commonly referred to in the trade as a pocket hard mount washer, comprising a cabinet 12 supporting a wash tub 14, a rotatably driven tumbler 15 within the wash tub 14 for receiving clothing or other items to be washed, and a front opening access door 16 to the wash tub 14. For supplying water to the wash tub 14 during selected wash and rinse cycles, a plurality of water supply hoses 17 are provided which each are controlled by a respective control valve 18 in a conventional manner. The control valves 18 in this instance each are mounted on a rear panel 19 within the machine cabinet 12.

For supplying chemicals, such as detergents, fabric softeners, bleaches, and the like during selected wash cycles, the individual chemicals in this case are contained in respective supply containers or barrels 22 and are supplied to the chemical dispenser 11 for injection into the wash water via respective chemical supply hoses 24 and peristaltic pumps 23, as is known in the art.

In accordance with the invention, the chemical dispenser has a novel design which facilitates efficient and reliable connection of the chemical supply hoses and which prevents or minimizes port breakage and leakage problems heretofore associated with the connection of such chemical supply hoses to the washer extractor. To this end, the dispenser 11 has a two-part construction comprising a dispenser body 25 and a removable and replaceable hose connection cap 26 to which the multiplicity of chemical supply hoses 24 can be secured and removed at locations remote from the washing machine 10. The dispenser body 25 in this case has an upright portion 25*a* that defines an elongated vertical mixing chamber 27 having a water inlet 28 at an upper end thereof, a relatively large diameter discharge opening 29 at a lower end, and a hub or port 25*b* intermediate the inlet and discharge ends for receiving the hose connection cap 26. The water inlet 28 is connectable to a selectively controllable water supply hose 30, and the discharge opening 29 is connected to a discharge hose 31 that communicates with the wash tub 14. The body 25 further has an outwardly extending hub 25*c* that defines overflow outlet or vent 34 located above the outlet 29.

The dispenser body 25 is mounted within the cabinet 12 with the cap receiving hub or port 25*b* and the overflow outlet defining hub 25*c* disposed within respective openings in the rear panel 19. For securing the dispenser body 25 in mounted position, the dispenser body 25 is formed with a plurality of mounting hubs 35, in this case disposed above and below the overflow outlet 34, that can be secured to the rear panel 19 by respective screws 36 from outside the cabinet.

The illustrated hose connection cap 26 has a cylindrical base 40 complementary in shape to a cylindrical configuration of the cap receiving hub or port 25*b* of the dispenser body 25 with a plurality of integrally formed upstanding hose connecting ports 41 communicating through the base 40, each for coupling with a respective chemical supply hose 24. To facilitate positioning of the hoses onto the ports 41, the outer ends 42 of the ports 41 in this case are chamfered or tapered.

For mounting the cap 26 in recessed relation to the hub 25*b*, the hub 25*b* is formed with elongated grooves 46*a* that define a bottom locating ledge 45 for positioning the cap 26 in predetermined mounted position, with the hose ports 41 protectively contained within the hub. In mounted position, the terminal ends of the hose ports 41 preferably are disposed coplanar, or slightly below the outer perimeter of the hub 25*b*. For positioning the cap 26 in predetermined circumferential relation to the hub 25*b*, the cap 26 is formed with a pair of diametrically opposed ribs 46 that are positionable into respective axial locating grooves 46*a* of the hub 25*b*. The ribs 46 in this case are formed along the outer perimeter of an annular wall 47 of the cap 26 that extends from the base 40 in the direction of the hose connecting ports 41. It will be understood that the ribs and grooves may be differently sized to provide a keyed arrangement for insuring that the cap 26 is located in a single predetermined circumferential position within the hub.

For releasably securing the hose connection cap 26 within the hub 25*b*, latches 50 are provided on diametrically opposed sides of the cap 26. The latches 50 in this case are in the form of a pair of resilient latch arms that extend from the base 40 outwardly beyond the annular wall 47 and are deflectable inwardly toward each other for snap action engagement with latch grooves 50*a* in the hub 25*b*. Manual deflection of the latch arms 50 toward each other permits unlatching and removal of the cap 26 from the hub 25*b*.

Hence, with the hose connection cap 26 removed from the dispenser, the chemical supply hoses 25 may be more easily and reliably connected to the ports 41 of the cap 26 without being constrained to a work location at the back panel 19 of the machine. Following securement of chemical supply hoses 24 to the respective ports 41 of the cap 26, the cap 26 may then be easily inserted and latched into position in the hub 25*b* with the ports 41 protectively contained within the hub 25*b*. Similarly, in the event of the need for service to the washing machine, the cap 26 may be unlatched and removed from the dispenser body 25 without the tedious necessity for disconnecting each of the chemical supply hoses 24. Replacement of the cap 26 following service similarly may be easily accomplished, without the necessity for re-clamping or connecting the individual hoses to the inlet ports of the dispenser.

In carrying out the invention, the hose connection cap 26 is made of a hard, more fracture and chemically resistant material than the dispenser body 25. The cap 26, for example, may be made of a commercially available plastic material, sold under the trade name KYNAR 720® plastic, while the dispenser body may be made of a less expensive plastic material. The more rigid cap material enables the chemical supply hoses to be securely clamped to the ports 41 with less risk of fracture or breakage of the ports, or leakage from loosely clamped chemical supply hoses. It will be appreciated by one skilled in the art that since the cap 26 is a relatively small component of the dispenser 11, it may be made of more durable and expensive material than the dispenser body 25, without significantly increasing the cost of the dispenser. Furthermore, since the dispenser body 25 is not subjected to high stress clamping of hoses, nor normally exposed to undiluted chemicals, as will become apparent, it may be made of less expensive plastic materials than heretofore possible, further enhancing the economical manufacturer of the dispenser.

In keeping with the invention, the hub 25*b* extends outwardly of the upright body portion 25*a* at an angle, in this case about 45°, to the vertical such that in the event any chemical leakage from the clamped ends of the hoses 24 on the ports 41 should occur, it will drain downwardly in the hub 25*b*. To facilitate such drainage, the base 40 of the cap 26 is foamed with drainage holes 52 at least about a lower portion thereof.

In a washing operation, it can be seen that when a selected chemical is directed to a respective hose 24 connected to the cap 26, the chemical will be dispersed downwardly through the hub or port 25*b* into the vertical chamber 27 of the upright body portion 25*a*. Simultaneously, for diluting the chemical and premixing it with water prior to introduction into the wash tub, water may be directed into the dispenser from the water inlet 28 in timed relation to the chemical injection.

For diverging the incoming water from the dispenser body inlet 28 to minimize entry into the hub 25*b*, the dispenser body 25 is formed with a V-shaped diverter 55 in directly opposed relation to the water inlet 28. The diverter 55 has a V-shaped construction defined by a pair of integrally formed plates 55*a* depending from a top wall of upright body portion 25*a* with an apex 55*b* in centered opposing relation to the water inlet 28. Pressurized water directed into the dispenser body 25 from the inlet 28 will engage the diverter 55 and be flared outwardly on opposite sides thereof so as not to directly enter or impinge upon the opening 56 through which the hub 25*b* communicates with the upright body portion 25*a*. For further preventing the direction of water into the hub 25*b*, the upright body portion 25*a* has a depending wall 58 extending a distance downwardly below the juncture between the upper perimeter of the hub 25*b* with the upright body portion 25*a*. The upright body portion 25*a* further has a depending wall 59 extending to a distance below the upper perimeter of the overflow outlet 34 for preventing a discharge of liquid during normal dispensing of chemicals.

In accordance with a further feature of the invention, the dispenser body 25 is formed with an upstanding wall 60 at the juncture of the bottom portion of the hub 25*b* and the upright body portion 25*a* for defining a pocket 61 for collecting any chemicals that might inadvertently leak from the hose connection ports 41. It will be appreciated by one skilled in the art by reason of the location of the pocket 61 adjacent a lower end of the hub 25*b*, it also will received and accumulate water directed into the dispenser from the water inlet 28 sufficient to dilute any chemical that should leak or otherwise accumulate in the pocket for preventing its corrosive effects. During normal operation of the dispenser 11, sufficient water and chemical is directed into the dispenser so that chemical and water in the pocket continues to be mixed and overflow for discharge from the outlet to the washer tub.

While in the illustrated embodiment, the dispenser 11 has a water inlet 28 at an upper end of the dispenser body 25, alternatively, one or more of the cap ports 41 may be utilized for connection to a water supply hose. In that case, the upper water inlet 28 may either be eliminated, not used, or used in conjunction with water supplied through the cap inlet ports 41 for more complete mixing with chemicals injected through other ports 41 of the cap.

The invention claimed is:

1. A washing machine comprising:

an outer cabinet, a wash tub disposed within said cabinet for receiving wash water during a washing operation, a rotatably driven tumbler for receiving launderable items for washing supported within said wash tub, a plurality of sources of different laundry chemicals located outside said cabinet for use during washing operations, a chemical dispenser connected to said plurality of sources of different laundry chemicals by a plurality of respective chemical supply hoses, said dispenser including a dispenser body mounted within said cabinet that defines a chamber into which laundry chemicals and water are directed and an outlet connected to and communicating with the wash tub, said dispenser body having a chemical inlet hub disposed in an opening of said cabinet and protruding outwardly from said cabinet for directing chemicals into said chamber, said dispenser including a hose connection cap separate from said dispenser body, said cap having a base and a plurality of integrally formed hose connecting ports extending outwardly of said base communicating through said cap, said chemical supply hoses each being connected to a respective one of said connecting ports for permitting selected dispensing of laundry chemicals from said hoses into said chamber for direction through said outlet to said wash tub during a washing operation, and said cap being mountably supported by an outer end of said hub without protruding into said chamber and being removable and replaceable on said hub without removal of said dispenser body from said cabinet and without removal of said hoses from said connecting ports.

2. The washing machine of claim 1 in which said hoses are connectable to said cap while said cap is removed from said dispenser.

3. The washing machine of claim 1 in which said hose connection cap and dispenser body are made of plastic material, and said hose connection cap is made of a plastic material different from the plastic material of said dispenser body so that they have different durability and corrosion-resistant characteristics.

4. The washing machine of claim 1 in which said cap and dispenser body have a releasable latching mechanism for enabling removable snap action engagement of the cap with said body.

5. The washing machine of claim 4 in which said cap has latch arms that are releasably engageable with said dispenser body.

6. The washing machine of claim 1 in which said cap is removably mountable in recessed relation in said hub.

7. The washing machine of claim 6 in which said cap is mountable in said hub with said hose connecting ports having terminal ends that extend outwardly no greater than an outer perimeter of said hub.

8. The washing machine of claim 6 in which said hub of said dispenser inlet hub extends outwardly of said outer cabinet at an acute angle to the vertical, and said cap is removably mountable in an outer end of said hub.

9. The washing machine of claim 8 in which said dispenser body has a water inlet connectable to a water supply hose for directing water into said body chamber simultaneously with the direction of laundry chemicals from said hose connecting ports.

10. The washing machine of claim 9 in which said water inlet is at an upper end of said dispenser body.

11. The washing machine of claim 10 in which said dispenser body has an upstanding portion that defines said dispensing chamber, and said hub communicates with said chamber through a side opening of said upstanding portion.

12. The washing machine of claim 11 in which said dispenser body has a central downwardly directed diverter wall adjacent an upper portion of said side opening in opposing relation to the water inlet for diverting water about opposite sides of said side opening.

13. The washing machine of claim 1 in which said dispenser body and cap have at least one cooperating key and key way for orienting said cap in predetermined circumferential relation to said hub upon mounting.

14. A washing machine comprising:

an outer cabinet, a wash tub disposed within said cabinet for receiving wash water during a washing operation, a rotatably driven tumbler for receiving launderable items for washing supported within said wash tub, a plurality of sources of different laundry chemicals located outside said cabinet for use during washing operations, a chemical dispenser connected to said plurality of sources of different laundry chemicals by a plurality of respective chemical supply hoses, said dispenser including a dispenser body that defines a chamber into which laundry chemicals and water are directed and an outlet connected to and communicating with the wash tub, said dispenser including a hose connection cap separate from said dispenser body having a plurality of hose connecting ports communicating through the cap, said chemical supply hoses each being connected to a respective one of said connecting ports for permitting selected dispensing of laundry chemicals from said hoses into said chamber for direction through said outlet to said wash tub during a washing operation, said dispenser having a cap receiving hub extending outwardly at an acute angle to the vertical, said cap being removably mountable in recessed relation in an outer end of said hub, said cap being removable and replaceable on said hub without removal of said hoses from said connecting ports, said dispenser body having a water inlet at an upper end of said dispenser connectable to a water supply hose for directing water into said body chamber simultaneously with the direction of laundry chemicals from said hose connecting ports, said dispenser body having an upstanding portion that defines said dispensing chamber, said hub communicating with said chamber through a side opening of said upstanding portion, and a wall extending upwardly from a lower portion of said hub for defining a pocket into which laundry chemicals and water directed into said dispenser may accumulate.

15. A washing machine comprising:

an outer cabinet, a wash tub disposed within said cabinet for receiving wash water during a washing operation, a rotatably driven tumbler for receiving launderable items for washing supported within said wash tub, a plurality of sources of different laundry chemicals located outside said cabinet for use during washing operations, a chemical dispenser connected to said plurality of sources of different laundry chemicals by a plurality of respective chemical supply hoses, said dispenser including a dispenser body that defines a chamber into which laundry chemicals and water are directed and an outlet connected to and communicating with the wash tub, said dispenser including a hose connection cap separate from said dispenser body having a plurality of hose connecting ports communicating through the cap, said chemical supply hoses each being connected to a respective one of said connecting ports for permitting selected dispensing of laundry chemicals from said hoses into said chamber for direction through said outlet to said wash tub during a washing operation, said dispenser having a cap receiving hub extending outwardly at an acute angle to the vertical, said cap being removably mountable in recessed relation in an outer end of said hub, said cap being removable and replaceable on said hub without removal of said hoses from said connecting ports, said dispenser body having a water inlet at an upper end connectable to a water supply hose for directing water into said body chamber simultaneously with the direction of laundry chemicals from said hose connecting ports, said dispenser body having an upstanding portion that defines said dispensing chamber, said hub communicating with said chamber through a side opening of said upstanding portion, and said dispenser body having a V-shaped diverter with an apex in opposed relation to said water inlet for dividing water directed into said chamber toward opposite sides of the chamber.

* * * * *